US006673529B1

(12) United States Patent
Daubendiek et al.

(10) Patent No.: US 6,673,529 B1
(45) Date of Patent: Jan. 6, 2004

(54) METHOD FOR MAKING TABULAR GRAIN SILVER HALIDE EMULSION

(75) Inventors: Richard L. Daubendiek, Rochester, NY (US); Jon N. Eikenberry, Rochester, NY (US); Barbara J. Fisher, Rochester, NY (US); Timothy R. Gersey, Rochester, NY (US); Joseph G. Lighthouse, Rochester, NY (US); Douglas L. Oehlbeck, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/193,341

(22) Filed: Jul. 11, 2002

(51) Int. Cl.[7] ..... G03C 1/005
(52) U.S. Cl. ..... 430/569; 430/567
(58) Field of Search ..... 430/569, 567

(56) References Cited

U.S. PATENT DOCUMENTS

| | | | |
|---|---|---|---|
| 2,222,264 | A | 11/1940 | Nietz et al. |
| 3,320,069 | A | 5/1967 | Illingworth |
| 4,433,048 | A | 2/1984 | Solberg et al. |
| 4,434,226 | A | 2/1984 | Wilgus et al. |
| 4,439,520 | A | 3/1984 | Kofron et al. |
| 4,853,323 | A | 8/1989 | Ikeda et al. |
| 4,914,014 | A | 4/1990 | Daubendiek et al. |
| 4,921,784 | A | 5/1990 | Ikeda et al. |
| 5,250,403 | A | 10/1993 | Antoniades et al. |
| 5,576,168 | A | 11/1996 | Daubendiek et al. |

OTHER PUBLICATIONS

Copending U.S. patent application Ser. No. 10/194,588, filed Jul. 1, 2002 entitled "High–Speed Thermally Developable Imaging Materials and Methods of Using Same".

*Primary Examiner*—Thorl Chea
(74) *Attorney, Agent, or Firm*—Andrew J. Anderson

(57) ABSTRACT

A process of preparing a high bromide tabular grain emulsion comprising a dispersion medium and silver halide grains including tabular grains having {111} major faces and an aspect ratio of at least 2, which contain greater than 50 mole percent bromide, based on silver, and which account for greater than 50 percent of total grain projected area, where such tabular grains have an average aspect ratio of at least 5, the process comprising (i) in a grain nucleation step creating in a dispersing medium tabular silver halide grain nuclei containing parallel twin planes and (ii) in a grain growth step subsequently growing the tabular grain nuclei into tabular grains in a silver halide reaction vessel by adding a silver ion source and a halide ion source to the reaction vessel and precipitating silver halide onto the tabular grain nuclei, wherein thiocyanate ion is introduced into the silver halide reaction vessel prior to the addition of at least the final 10 mole percent of the total silver added to the reaction vessel, and further wherein the introduced thiocyanate ion concentration is at most 0.4 mole %, based on the total silver added to the reaction vessel. Use of thiocyanate during grain precipitation result in increased aspect ratio without degrading morphological purity.

15 Claims, No Drawings

METHOD FOR MAKING TABULAR GRAIN SILVER HALIDE EMULSION

FIELD OF THE INVENTION

This invention relates to an improved method for preparing tabular grain silver halide emulsions, and to photographic elements which contain one or more of such improved emulsions.

BACKGROUND OF THE INVENTION

The photographic advantages of high bromide tabular grain emulsions were first demonstrated by Wilgus et al U.S. Pat. No. 4, 434,226, Kofron et al U.S. Pat. No. 4,439,520 and Solberg et al. U.S. Pat. No. 4,433,048, in which patents it was recognized that the chemically and spectrally sensitized emulsions disclosed in one or more of their various forms would be useful in color photography and in black-and-white photography (including indirect radiography). The high bromide tabular grain emulsions were prepared by creating tabular grain nuclei under a specified set of conditions and then growing these nuclei by the concurrent addition of silver and halide ions. Kofron et al, e.g., disclosed and demonstrated striking photographic advantages for chemically and spectrally sensitized tabular grain emulsions in which tabular grains having an average aspect ratio of greater than 8 account for greater than 50 percent of total grain projected area of the emulsion grains. Solberg et al. demonstrated advantages for high bromide tabular silver iodobromide grain emulsions having a lower proportion of iodide in a central region than in a laterally displaced region.

The advantages of tabular grain emulsions have further been demonstrated in many subsequent references, especially in regard to their increased surface area to volume ratio compared to three dimensional grains of equal mass, such as cubes or octahedra. As a consequence of this larger surface area to volume ratio, tabular emulsions offer a number of photographic advantages, including a higher spectral to intrinsic speed ratio, improved granularity at a given spectral speed, higher covering power, and decreased turbidity. Aspect ratio, which is the ratio of tabular grain thickness to diameter (usually the diameter of a circle of equivalent area), is a figure of merit that correlates directly with the magnitude of potential advantage that a tabular grain emulsion offers. Thus if two tabular grain emulsions have the same mean grain diameter, but different aspect ratios, they have potential to be of approximately equivalent spectral speed when optimally sensitized. However, the one that has higher aspect ratio (i.e., the emulsion comprising thinner grains where such emulsions have the same mean grain diameter) has potential to form images of lower granularity, for example, in a color negative film.

U.S. Pat. No. 4,914,014 describes a process for making tabular grain emulsions wherein nucleation is carried out at high pBr, which is useful for precipitation of thin tabular emulsions. U.S. Pat. No. 5,250,403 demonstrates improved specularity (decreased turbidity) of very thin tabular emulsions vs. that of thicker tabular grain emulsions, and the importance of morphological purity in thin tabular emulsions.

The use of thiocyanate ions during preparation of photographic elements has been suggested in the art, primarily for increasing photographic sensitivity. U.S. Pat. No. 2,222,264, e.g., discloses use of thiocyanate in precipitation of AgBrI emulsions. The inventors indicate that an "amount of thiocyanate equal to from about 2 to about 15% by moles of the silver halide in the emulsion" may be employed. They further state that "larger amounts of thiocyanate can be employed, particularly if the thiocyanate is added before washing", and they claim an emulsion containing about 0.05 to 2 mole-% (after washing). These inventors make no mention of grain morphology, and in particular, they do not teach levels that are appropriate for precipitation of tabular grain emulsions.

U.S. Pat. No. 3,320,069 discloses use of a water-soluble thiocyanate compound at a level of "5–50 grams per mole of silver halide." Although the inventors do not specify a particular water-soluble thiocyanate compound, if it pertains to the sodium salt as used in some of their examples, this 5–50 gram level corresponds to 6.16 to 61.6 mole-% based on silver halide. The inventors do not describe the morphology of their emulsions, and in particular offer no teaching regarding use of thiocyanate in precipitation of tabular grain emulsions. U.S. Pat. No. 4,853,323 discloses use of thiocyanate at a concentration of 0.5 to 60 mole % (preferably 2 to 40 mole %) of Ag in precipitation of emulsions. This patent, and closely related patent U.S. Pat. No. 4,921,784, also specify a spectral characteristic in which the resulting emulsion shows a particular intensity of IR absorption of thiocyanate ion at 2052 $cm^{-1}$. While a statement is included that tabular grain emulsions having an aspect ratio of 5 or more can be used in the invention, there is no teaching as to the effect thiocyanate addition would actually have on the preparation of such emulsions.

U.S. Pat. No. 4,433,048 mentions possible use of thiocyanate in tabular emulsions, but gives no guidance regarding the specific time in the emulsion preparation process at which it should be added, does not indicate preferred amounts, and does not describe expected effects.

Because aspect ratio is a direct correlate to potential advantage of tabular emulsions, methods to increase this figure of merit during tabular grain preparations are sought. Also, because of the continuous desire for higher photographic speed, larger grain emulsions are required. Thus, precipitation methods for producing tabular grain emulsions which maintain or increase aspect ratios would be especially valued.

SUMMARY OF THE INVENTION

In one aspect this invention is directed towards a process of preparing a high bromide tabular grain emulsion comprising a dispersion medium and silver halide grains including tabular grains having {111 } major faces and an aspect ratio of at least 2, which contain greater than 50 mole percent bromide, based on silver, and which account for greater than 50 percent of total grain projected area, where such tabular grains have an average aspect ratio of at least 5, the process comprising (i) in a grain nucleation step creating in a dispersing medium tabular silver halide grain nuclei containing parallel twin planes and (ii) in a grain growth step subsequently growing the tabular grain nuclei into tabular grains in a silver halide reaction vessel by adding a silver ion source and a halide ion source to the reaction vessel and precipitating silver halide onto the tabular grain nuclei, wherein thiocyanate ion is introduced into the silver halide reaction vessel prior to the addition of at least the final 10 mole percent of the total silver added to the reaction vessel, and further wherein the introduced thiocyanate ion concentration is at most 0.4 mole %, based on the total silver added to the reaction vessel.

In a further aspect, this invention is directed towards a photographic element comprised of a support, and a silver halide emulsion layer coated on the support comprised of an emulsion prepared in accordance with the process of the invention.

We have found that while use of prior art suggested levels of thiocyanate in tabular grain emulsion precipitation typically results in decreased aspect ratio and degraded morphological purity, use of levels of thiocyanate lower than taught in prior art during grain precipitation surprisingly result in increased aspect ratio without degrading morphological purity.

DETAILED DESCRIPTION OF THE INVENTION

The invention is directed to an improved process for the preparation of tabular grain photographic emulsions. The emulsions are specifically contemplated for incorporation in camera speed color or black and white photographic films, as well as in radiographic film elements, including photothermographic elements.

As used herein, the term "tabular" grain refers to silver halide grains having an aspect ratio of at least 2, where aspect ratio is defined as the equivalent circular diameter (ECD) of the major face of the grain divided by the grain thickness. Tabular grain emulsions prepared in accordance with the invention have a grain population accounting for at least 50% of the total grain projected area comprising tabular grains having an average aspect ratio of at least 5, and more preferably at least 8. Tabular grain emulsions prepared in accordance with the invention further preferably comprise tabular grains which have an average tabularity (T) of greater than 25 (more preferably greater than 100), where the term "tabularity" is employed in its art recognized usage as $T=ECD/t^2$ where ECD is the average equivalent circular diameter of the tabular grains in micrometers and t is the average thickness in micrometers of the tabular grains. Tabularity increases markedly with reductions in tabular grain thickness. Preferably, tabular grain emulsions prepared in accordance with the invention have an average thickness of less than 0.3 micrometers for green or red sensitized emulsions, and 0.5 micrometers for blue sensitive emulsions. Tabular grain emulsions with mean tabular grain thicknesses of less than about 0.10 $\mu$m are herein referred to as "ultrathin" tabular grain emulsions.

Concerning tabular grains in general, to maximize the advantages of high tabularity it is generally preferred that tabular grains satisfying the stated criteria account for the highest conveniently attainable percentage of the total grain projected area of an emulsion, with at least 50% total grain projected area (%TGPA) being typical. For example, in preferred emulsions, tabular grains satisfying the stated criteria above account for at least 70 percent of the total grain projected area. In the highest performance tabular grain emulsions, tabular grains satisfying the criteria above account for at least 90 percent of total grain projected area.

Tabular grain emulsions are prepared in accordance with the invention by the combination of (i) a grain nucleation step creating in a dispersing medium tabular silver halide grain nuclei containing parallel twin planes and (ii) a grain growth step subsequently growing the tabular grain nuclei into tabular grains in a silver halide reaction vessel by adding a silver ion source and a halide ion source to the reaction vessel and precipitating silver halide onto the tabular grain nuclei.

With respect to grain nucleation step (i), well-known conventional single or double jet precipitation techniques may be employed. In a preferred embodiment, e.g., the balanced double jet precipitation of grain nuclei is specifically contemplated in which an aqueous silver salt solution and an aqueous bromide salt are concurrently introduced into a dispersing medium containing water and a hydrophilic colloid peptizer. Prior to introducing the silver salt a small amount of bromide salt is preferably added to the reaction vessel to establish a slight stoichiometric excess of halide ion. One or both of chloride and iodide salts can be introduced through the bromide jet or as a separate aqueous solution through a separate jet. The halide ions may be introduced as separate or mixed solutions, of, e.g., sodium, potassium, or ammonium salts, or as fine grain suspensions such as Lippmann AgCl, AgBr, or AgI. It is preferred to limit the concentration of chloride and/or iodide to less than about 20 mole percent, based on silver, and most preferably these other halides are present in concentrations of less than 10 mole percent (optimally less than 6 mole percent) based on silver. Silver nitrate is the most commonly utilized silver salt while the halide salts most commonly employed are ammonium halides and alkali metal (e.g., lithium, sodium or potassium) halides.

Instead of introducing aqueous silver and halide salts through separate jets, a uniform nucleation can be achieved by introducing a Lippmann emulsion into the dispersing medium. Since the Lippmann emulsion grains typically have a mean ECD of less than 0.05 micrometer, a small fraction of the Lippmann grains initially introduced serve as deposition sites while all of the remaining Lippmann grains dissociate into silver and halide ions that precipitate onto grain nuclei surfaces. Techniques for using small, preformed silver halide grains as a feedstock for emulsion precipitation are illustrated by Mignot U.S. Pat. No. 4,334,012; Saito U.S. Pat. No. 4,301,241; and Solberg et al U.S. Pat. No. 4,433,048.

The invention is compatible with either of the two most common techniques for introducing parallel twin planes into grain nuclei. The preferred and most common of these techniques is to form the grain nuclei population that will be ultimately grown into tabular grains while concurrently introducing parallel twin planes in the same precipitation step. In other words, grain nucleation occurs under conditions that are conducive to twinning. The second approach is to form a stable grain nuclei population and then adjust the pAg of the interim emulsion to a level conducive to twinning. Regardless of which approach is employed, it is advantageous to introduce the twin planes in the grain nuclei at an early stage of precipitation. It is contemplated to obtain a grain nuclei population containing parallel twin planes using less than 5 percent of the total silver used to form the tabular grain emulsion, preferably less than 2 mole percent and more preferably less than 1 mole percent. It is usually convenient to use at least 0.05 percent of the total silver to form the parallel twin plane containing grain nuclei population, although this can be accomplished using even less of the total silver. The longer introduction of parallel twin planes is delayed after forming a stable grain nuclei population the greater is the tendency toward increased grain dispersity.

At the stage of introducing parallel twin planes in the grain nuclei, either during initial formation of the grain nuclei or immediately thereafter, the lowest attainable levels of grain dispersity in the completed emulsion are achieved by control of the dispersing medium. The pAg of the dispersing medium is preferably maintained in the range of from 5.4 to 10.3, and more preferably in the range of from 7.0 to 10.0. At a pAg of greater than 10.3 a tendency toward increased tabular grain ECD and thickness dispersities may be observed. Any convenient conventional technique for monitoring and regulating pAg can be employed.

Reductions in grain dispersities have also been observed as a function of the pH of the dispersing medium. Both the incidence of nontabular grains and the thickness dispersities of the nontabular grain population have been observed to decrease when the pH of the dispersing medium is less than 6.0 at the time parallel twin planes are being introduced into the grain nuclei. The pH of the dispersing medium can be regulated in any convenient conventional manner. A strong mineral acid, such as nitric acid, can be used for this purpose.

Grain nucleation and growth occurs in a dispersing medium comprised of water, dissolved salts and a conventional peptizer. Hydrophilic colloid peptizers such as gelatin and gelatin derivatives are specifically contemplated. Peptizer concentrations of from 20 to 800 (optimally 40 to 600) grams per mole of silver introduced during the nucleation step have been observed to produce emulsions of the lowest grain dispersity levels.

The formation of grain nuclei containing parallel twin planes is undertaken at conventional precipitation temperatures for photographic emulsions, with temperatures in the range of from 20 to 80C being particularly preferred and temperature of from 20 to 60C being optimum.

Once a population of grain nuclei containing parallel twin planes has been established as described above, the next step is preferably to reduce the dispersity of the grain nuclei population by ripening. The objective of ripening grain nuclei containing parallel twin planes to reduce dispersity is disclosed by both Himmelwright U.S. Pat. No. 4,477, 565 and Nottorf U.S. Pat. No. 4,722,886, the disclosures of which are here incorporated by reference. Ammonia and thioethers in concentrations of from about 0.01 to 0.1N constitute preferred ripening agent selections. Instead of introducing a silver halide solvent to induce ripening, it is possible to accomplish the ripening step by adjusting pH to a high level—e.g., greater than 9.0. A ripening process of this type is disclosed in U.S. Pat. No. 5,013,641. Ripening may also be accomplished simply by holding the grain population at increased temperatures prior to subsequent grain growth.

Some reduction in dispersity will occur no matter how abbreviated the period of ripening. It is preferred, however, to continue ripening until at least about 20 percent of the total silver has been solubilized and redeposited on the remaining grain nuclei. The longer ripening is extended the fewer will be the number of surviving nuclei. This means that progressively less additional silver halide precipitation is required to produce tabular grains of an aim ECD in a subsequent growth step. Looked at another way, extending ripening decreases the size of the emulsion make in terms of total grams of silver precipitated. Optimum ripening will vary as a function of aim emulsion requirements and can be adjusted as desired.

Once nucleation and ripening have been completed, further growth of the silver halide grains can be undertaken in any conventional manner consistent with achieving desired final mean grain thicknesses and ECDs. The halides introduced during grain growth can be selected independently of the halide selections for nucleation. The tabular grain emulsion can contain grains of either uniform or non-uniform silver halide composition. Although the formation of grain nuclei preferably incorporates bromide ion and only minor amounts of chloride and/or iodide ion, the tabular grain emulsions produced at the completion of the growth step can contain in addition to bromide ions any one or combination of iodide and chloride ions in any proportions which may be found in high bromide tabular grain emulsions. Growth may be accomplished via double jet addition of silver and halide salt solutions as in grain nucleation, or by addition of high bromide fine grains previously formed. If desired, the growth of the tabular grain emulsion can be completed in such a manner as to form a core-shell emulsion. The shelling procedure taught by Evans et al U.S. Pat. No. 4,504,570, e.g., is here incorporated by reference. Internal doping of the tabular grains, such as with group VIII metal ions or coordination complexes, conventionally undertaken to obtain improved photographic properties, are specifically contemplated.

In the process of the invention, thiocyanate ion is introduced to a silver halide reaction vessel prior to the addition of at least the final 10 percent of silver to the reaction vessel, more preferably prior to the addition of the final 50 percent of silver, and most preferably prior to the addition of the final 90 percent of silver is added, at a concentration of at most 0.4 mole %, based on the total silver added to the reaction vessel. Preferably, at least 0.01 mole % thiocyanate ion is introduced, based on total silver, more preferably from 0.05 to 0.3 mole %. Possible sources of thiocyanate ion include NASCN, KSCN, and $NH_4SCN$. In an especially preferred embodiment, the thiocyanate ion is added after a grain nucleation step wherein less than 5 percent (preferably less than 2 percent and more preferably less than 1 percent) of silver is added to the reaction vessel, and prior to subsequent grain growth steps wherein the balance of silver is added.

While typical grain nucleation and growth steps for forming high bromide tabular grain emulsions are generally described above, the process of the invention applies to any known process for precipitating high bromide tabular grain emulsions which may be modified in accordance with the invention to include thiocyanate during growth of such emulsion grains. Representative high bromide tabular grain emulsion preparation processes which may be modified in accordance with the invention include a variety of conventional teachings, e.g., those described in the following references: *Research Disclosure*, Item 22534, January 1983, published by Kenneth Mason Publications, Ltd., Emsworth, Hampshire P010 7DD, England; Daubendiek et al U.S. Pat. No. 4,414,310; Solberg et al U.S. Pat. No. 4,433,048; Wilgus et al U.S. Pat. No. 4,434,226; Maskasky U.S. Pat. No. 4,435,501; Kofton et al U.S. Pat. No. 4,439,520; Yarada et al U.S. Pat. No. 4,647,528, Sugimoto et al U.S. Pat. No. 4,665,012; Daubendiek et al U.S. Pat. No. 4,672,027; Yamada et al U.S. Pat. No. 4,679,745; Daubendiek et al U.S. Pat. No. 4,693,964; Maskasky U.S. Pat. No. 4,713,320; Nottorf U.S. Pat. No. 4,722,886; Sugimoto U.S. Pat. No. 4,755,456; Goda U.S. Pat. No. 4,775,617; Ellis U.S. Pat. No. 4,801,522; Ikeda et al U.S. Pat. No. 4,806,461; Ohashi et al U.S. Pat. No. 4,835,095; Makino et al U.S. Pat. No. 4,835, 322; Daubendiek et al U.S. Pat. No. 4,914,014; Aida et al U.S. Pat. No. 4,962,015; Ikeda et al U.S. Pat. No. 4,985,350; Piggin et al U.S. Pat. No. 5,061,609; Piggin et al U.S. Pat. No. 5,061,616; Tsaur et al U.S. Pat. No. 5,147,771, Tsaur et al U.S. Pat. No. 5,147,772; Tsaur et al U.S. Pat. No. 5,147,773; Tsaur et al U.S. Pat. No. 5,171,659; Tsaur et al U.S. Pat. No. 5,210,013; Black et al U.S. Pat. No. 5,219,720; Kim et al U.S. Pat. No. 5,236,817; Brust U.S. Pat. No. 5,248,587; Antoniades et al U.S. Pat. No. 5,250,403; Tsaur et al U.S. Pat. No. 5,252,453; Kim et al U.S. Pat. No. 5,272,048; Delton U.S. Pat. No. 5,310,644; Black et al U.S.

Pat. No. 5,334,495; Chaffee et al U.S. Pat. No. 5,358,840; Delton U.S. Pat. No. 5,372,927; Cohen et al U.S. Pat. No. 5,391,468; Maskasky U.S. Pat. No. 5,411,851; Maskasky U.S. Pat. No. 5,411,853; Maskasky U.S. Pat. No. 5,418,125; Delton U.S. Pat. No. 5,460,934; Wen U.S. Pat. No. 5,470,698; Fenton et al U.S. Pat. No. 5,476,760.

High bromide tabular grain emulsions prepared in accordance with the invention preferably contain greater than 70 mole percent, and optimally at least 90 mole percent bromide, based on total silver. In one form the high bromide tabular grains can be silver bromide grains. It is also possible to include minor amounts of chloride ion and/or iodide ion in the tabular grains. Silver chloride, like silver bromide, forms a face centered cubic crystal lattice structure. Therefore, all of the halide not accounted for by bromide can be chloride, if desired. Chloride preferably accounts for no more than 20 mole percent, most preferably no more than 15 mole percent of total silver. Iodide can be present in concentrations ranging up to its saturation limit, but is usually limited to 20 mole percent or less, preferably 12 mole percent or less. The tabular grains thus may include silver iodobromide, silver chlorobromide, silver iodochlorobromide and silver chloroiodobromide grains, where the halides are named in their order of ascending concentration. Silver iodobromide and chloroiodobromide grains represent a preferred form of high bromide tabular grains. For camera speed films it is generally preferred that the tabular grains contain at least 0.25 (more preferably at least 0.5 and most preferably at least 1.0) mole percent iodide, based on silver, most preferably in the range of from about 1 to 12 mole percent iodide.

In a preferred embodiment of the invention, the tabular grain emulsions prepared comprise ultrathin tabular grains which have {111} major faces; contain greater than 70 mole percent bromide (more preferably greater than 85 mole percent, and most preferably greater than 90 mole percent), based on silver, account for greater than 70 percent of total grain projected area (more preferably greater than 85 mole percent, and most preferably greater than 90 mole percent); exhibit an average ECD of at least 0.5 μm (more preferably at least 0.7 μm); and exhibit an average thickness of less than or equal to about 0.10 μm (more preferably less than 0.08 μm). Such emulsion grains further preferably comprise and at least 0.25 mole percent iodide. Although these ultrathin grain criteria may be too stringent to be satisfied by the majority of known tabular grain emulsion preparation processes, a few published precipitation techniques are capable of producing emulsions satisfying such criteria. U.S. Pat. No. 5,250,403, here incorporated by reference, demonstrates preferred processes for preparing silver iodobromide emulsions satisfying these criteria. Zola and Bryant EP 0 362 699 also discloses processes for preparing silver iodobromide emulsions satisfying these criteria. Daubendiek et al. U.S. Pat. No. 5,576,168 discloses further preferred procedures for preparation of ultrathin tabular grains, the disclosures of which are incorporated by reference herein.

Tabular grain emulsions prepared in accordance with preferred embodiments of the invention preferably comprise tabular grains which account for greater than 70 percent, and more preferably greater than 90 percent, of total grain projected area of the emulsion. Providing emulsions in which the tabular grains account for a high percentage of total grain projected area is important to achieving the highest attainable image sharpness levels, particularly in multilayer color photographic films. It is also important to utilizing silver efficiently and to achieving the most favorable speed-granularity relationships. The process of the invention wherein thiocyanate ions are added during precipitation of high bromide tabular grain emulsions helps achieve such desired features.

The tabular grains accounting for greater than 50 percent of total grain projected area of the tabular grain emulsion prepared in accordance with the invention preferably exhibit an average ECD of at least 0.5 μm, and more preferably at least 0.7 μm. The advantage to be realized by maintaining the average ECD of at least 0.7 μm is demonstrated in Tables III and IV of U.S. Pat. No. 5,250,403. Although emulsions with extremely large average grain ECD's are occasionally prepared for scientific grain studies, for photographic applications ECD's are conventionally limited to less than 10 Am and in most instances are less than 5 μm. An optimum ECD range for moderate to high image structure quality is in the range of from 1 to 4 μm.

In the tabular grain emulsions prepared in preferred embodiments of the invention the tabular grains accounting for greater than 90 percent of total grain projected area exhibit a mean thickness of less than 0.08 μm. At a mean grain thickness of less than 0.08 μm there is little variance between reflectance in the green and red regions of the spectrum. Additionally, compared to tabular grain emulsions with mean grain thicknesses in the 0.08 to 0.20 μm range, differences between minus blue and blue reflectances are not large. This decoupling of reflectance magnitude from wavelength of exposure in the visible region simplifies film construction in that green and red recording emulsions (and to a lesser degree blue recording emulsions) can be constructed using the same or similar tabular grain emulsions. If the mean thicknesses of the tabular grains are further reduced below 0.07 μm, the average reflectances observed within the visible spectrum are also reduced. Therefore, it is preferred to maintain mean grain thicknesses at less than 0.07 μm. Generally the lowest mean tabular grain thickness conveniently realized by the precipitation process employed is preferred. Ultrathin tabular grain emulsions with mean tabular grain thicknesses down to about 0.02 μm are readily realized. Daubendiek et al U.S. Pat. No. 4,672,027, e.g., reports a process wherein mean tabular grain thicknesses of 0.017 μm is obtained. Utilizing the grain growth techniques taught by U.S. Pat. No. 5,250,403 these emulsions could be grown to average ECD's of at least 0.7 μm without appreciable thickening—e.g., while maintaining mean thicknesses of less than 0.02 μm. The minimum thickness of a tabular grain is limited by the spacing of the first two parallel twin planes formed in the grain during precipitation. Although minimum twin plane spacings as low as 0.002 μm (i.e., 2 nm or 20 Å) have been observed in the emulsions of U.S. Pat. No. 5,250,403, U.S. Pat. No. 4,439,520 suggests a practical minimum tabular grain thickness of about 0.01 μm.

Preferred tabular grain emulsions prepared in accordance with the invention are those in which grain to grain variance is held to low levels. U.S. Pat. No. 5,250,403 reports tabular grain emulsions in which greater than 90 percent of the tabular grains have hexagonal major faces. U.S. Pat. No. 5,250,403 also reports tabular grain emulsions exhibiting a coefficient of variation (COV) based on ECD of less than 25 percent and even less than 20 percent. Modification of the preparation processes for such emulsions by incorporation of a thiocyanate ion during grain precipitation in accordance with the present invention can lead to further improvements in tabular grain uniformity. Disproportionate size range reductions in the size-frequency distributions of tabular grains having greater than mean ECD's (hereinafter referred to as the $>ECD_{av}$ grains) can further be realized by modifying the procedure for precipitation of the tabular grain emulsions in the following manner: Tabular grain nucleation is conducted employing gelatino-peptizers that have not been treated to reduce their natural methionine content while grain growth is conducted after substantially eliminating the methionine content of the gelatino-peptizers present and subsequently introduced. A convenient approach for accomplishing this is to interrupt precipitation after nucleation and before growth has progressed to any significant degree to introduce a methionine oxidizing agent. Any of the conventional techniques for oxidizing the methionine of a gelatino-peptizer can be employed, such as discussed in U.S. Pat. No. 5,576,168.

Subsequent to precipitation of high bromide tabular grain emulsions in accordance with the invention, such emulsions may be further chemically and spectrally sensitized in accordance with conventional techniques. Chemical sensitization may include epitaxial sensitizations, wherein the tabular grains receive during chemical sensitization a relatively small molar amount (e.g., from 0.5 to 7 mole percent, based on total silver, where total silver includes that in the host and epitaxy) of epitaxially deposited silver halide forming protrusions at selected sites on the tabular grain surfaces, such as described by U.S. Pat. Nos. 4,435,501 and 5,576,168 cited above and here incorporated by reference. Silver halide epitaxy can by itself increase photographic speeds to levels comparable to those produced by substantially optimum chemical sensitization with sulfur and/or gold. Additional increases in photographic speed can be realized when the tabular grains with the silver halide epitaxy deposited thereon are additionally chemically sensitized with conventional middle chalcogen (i.e., sulfur, selenium or tellurium) sensitizers or noble metal (e.g., gold) sensitizers. A general summary of these conventional approaches to chemical sensitization that can be applied to silver halide epitaxy sensitizations are contained in *Research Disclosure December* 1989, Item 308119, Section III. Chemical sensitization. U.S. Pat. No. 4,439,520 illustrates the application of these sensitizations to tabular grain emulsions.

A specifically preferred approach to chemical sensitization employs a combination of sulfur containing ripening agents in combination with middle chalcogen (typically sulfur) and noble metal (typically gold) chemical sensitizers. Contemplated sulfur containing ripening agents include thioethers, such as the thioethers illustrated by McBride U.S. Pat. No. 3,271,157, Jones U.S. Pat. No. 3,574,628 and Rosencrants et al U.S. Pat. No. 3,737,313. Preferred sulfur containing ripening agents are thiocyanates, illustrated by Nietz et al U.S. Pat. No. 2,222,264, Lowe et al U.S. Pat. No. 2,448,534 and Illingsworth U.S. Pat. No. 3,320,069. A preferred class of middle chalcogen sensitizers are tetra-substituted middle chalcogen ureas of the type disclosed by Herz et al U.S. Pat. Nos. 4,749,646 and 4,810,626, the disclosures of which are here incorporated by reference. Preferred compounds include those represented by the formula:

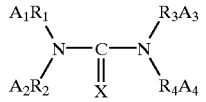

(V)

wherein X is sulfur, selenium or tellurium; each of $R_1$, $R_2$, $R_3$ and $R_4$ can independently represent an alkylene, cycloalkylene, alkarylene, aralkylene or heterocyclic arylene group or, taken together with the nitrogen atom to which they are attached, $R_1$ and $R_2$ or $R_3$ and $R_4$ complete a 5 to 7 member heterocyclic ring; and each of $A_1$, $A_2$, $A_3$ and $A_4$ can independently represent hydrogen or a radical comprising an acidic group; with the proviso that at least one $A_1R_1$ to $A_4R_4$ contains an acidic group bonded to the urea nitrogen through a carbon chain containing from 1 to 6 carbon atoms.

X is preferably sulfur and $A_1R_1$ to $A_4R_4$ are preferably methyl or carboxymethyl, where the carboxy group can be in the acid or salt form. A specifically preferred tetra-substituted thiourea sensitizer is 1,3-dicarboxymethyl-1,3-dimethylthiourea.

Preferred gold sensitizers are the gold(I) compounds disclosed by Deaton U.S. Pat. No. 5,049,485, the disclosure of which is here incorporated by reference. These compounds include those represented by the formula:

$$AuL_2^+X^- \text{ or } AuL(L^1)^+X^- \quad \text{(VI)}$$

wherein L is a mesoionic compound; X is an anion; and $L^1$ is a Lewis acid donor.

A general summary of useful spectral sensitizing dyes is provided by *Research Disclosure*, December 1989, Item 308119, Section IV. Spectral sensitization and desensitization, A. Spectral sensitizing dyes. U.S. Pat. No. 4,439,520 discloses advantages for "dye in the finish" sensitizations, which are those that introduce the spectral sensitizing dye into the emulsion prior to the heating step (finish) that results in chemical sensitization. While a spectral sensitizing dye can act also as a site director and/or can be present during the finish, the only required function that a spectral sensitizing dye perform is to increase the sensitivity of the emulsion to at least one region of the spectrum. Hence, the spectral sensitizing dye can, if desired, be added to a tabular grain prepared according to the invention after chemical sensitization has been completed. The spectral sensitizing dyes disclosed by U.S. Pat. No. 4,439,520, particularly the blue spectral sensitizing dyes shown by structure and their longer methine chain analogous that exhibit absorption maxima in the green and red portions of the spectrum, are particularly preferred for incorporation in ultrathin tabular grain emulsions.

Since ultrathin tabular grain emulsions exhibit significantly smaller mean grain volumes than thicker tabular grains of the same average ECD, native silver halide sensitivity in the blue region of the spectrum is lower for ultrathin tabular grains. Hence blue spectral sensitizing dyes improve photographic speed significantly, even when iodide levels in the ultrathin tabular grains are relatively high. At exposure wavelengths that are bathochromically shifted in relation to native silver halide absorption, ultrathin tabular grains depend almost exclusively upon the spectral sensitizing dye or dyes for photon capture. Hence, spectral sensitizing dyes with light absorption maxima at wavelengths longer than 430 nm (encompassing longer wavelength blue, green, red and/or infrared absorption maxima) adsorbed to the grain surfaces of ultrathin grain emulsions produce very large speed increases. This is in part attributable to relatively lower mean grain volumes and in part to the relatively higher mean grain surface areas available for spectral sensitizing dye adsorption.

Aside from the features of tabular grain emulsions described above, emulsions prepared in accordance with this invention can take any desired conventional form. For example, in accordance with conventional practice, after an emulsion satisfying the requirements of the invention has been prepared, it can be blended with one or more other emulsions. Conventional emulsion blending is illustrated in

*Research Disclosure*, Vol. 308, Item 308119, Section I, Paragraph I, the disclosure of which is here incorporated by reference.

The tabular grain emulsions prepared in accordance with the invention may be used in any type of photographic element, including photothermographic elements, and in one embodiment are preferably used in multicolor elements which contain image dye-forming units sensitive to each of the three primary regions of the spectrum. Each unit can comprise a single emulsion layer or multiple emulsion layers sensitive to a given region of the spectrum. A typical multicolor photographic element may comprise, e.g., a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers and subbing layers. The layers of the element, including the layers of the image-forming units, can be arranged in various orders as known in the art.

In a further embodiment, ultrathin tabular grain emulsions prepared in accordance with preferred embodiments of the invention may be used in high speed thermally developable imaging materials such as described in concurrently filed, commonly assigned copending U.S. Ser. No. 10/194,588 of Chaofeng Zou et al, the disclosure of which is incorporated by reference herein.

If desired, the photographic elements employing emulsions prepared in accordance with the invention can be used in conjunction with an applied magnetic layer as described in *Research Disclosure*, November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, available from the Japanese Patent Office. When it is desired to employ the inventive materials in a small format film, *Research Disclosure*, June 1994, Item 36230, provides suitable embodiments.

In the following discussion of suitable materials for use in photographic products, reference will be made to *Research Disclosure*, September 1994, Item 36544, available as described above, which will be identified hereafter by the term "Research Disclosure". Sections hereafter referred to are Sections of the Research Disclosure.

Except as provided, elements containing silver halide emulsions in accordance with this invention can be either negative-working or positive-working as indicated by the type of processing instructions (i.e. color negative, reversal, or direct positive processing) provided with the element. Suitable methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Scan facilitating is described in Section XIV. Supports, exposure, development systems, and processing methods and agents are described in Sections XV to XX. Certain desirable photographic elements and processing steps, particularly those useful in conjunction with color reflective prints, are described in *Research Disclosure*, Item 37038, February 1995.

Image dye-forming couplers may be included in the element such as couplers that form cyan dyes upon reaction with oxidized color developing agents which are described in such representative patents and publications as: U.S. Pat. Nos. 2,367,531, 2,423,730, 2,474,293, 2,772,162, 2,895,826, 3,002,836, 3,034,892, 3,041,236, 4,333,999, 4,883,746 and "Farbkuppler-eine Literature Ubersicht," published in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent are described in such representative patents and publications as: U.S. Pat. Nos. 2,311,082, 2,343,703, 2,369,489, 2,600,788, 2,908,573, 3,062,653, 3,152,896, 3,519,429, 3,758,309, 4,540,654, and "Farbkuppler-eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized color developing agent are described in such representative patents and publications as: U.S. Pat. Nos. 2,298,443, 2,407,210, 2,875,057, 3,048,194, 3,265,506, 3,447,928, 4,022,620, 4,443,536, and "Farbkuppler-eine Literature Ubersicht," published in Agfa Mitteilungen, Band III, pp. 112–126 (1961). Such couplers are typically open chain ketomethylene compounds.

Couplers that form colorless products upon reaction with oxidized color developing agent are described in such representative patents as: UK. Pat. No. 861,138; U.S. Pat. Nos. 3,632,345, 3,928,041, 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

The invention materials may be used in association with materials that accelerate or otherwise modify the processing steps e.g. of bleaching or fixing to improve the quality of the image. Bleach accelerator releasing couplers such as those described in EP 193,389; EP 301,477; U.S. Pat. No. 4,163,669; U.S. Pat. No. 4,865,956; and U.S. Pat. No. 4,923,784, may be useful. Also contemplated is use of the compositions in association with nucleating agents, development accelerators or their precursors (UK Patent 2,097,140; UK. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in elements in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969). Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

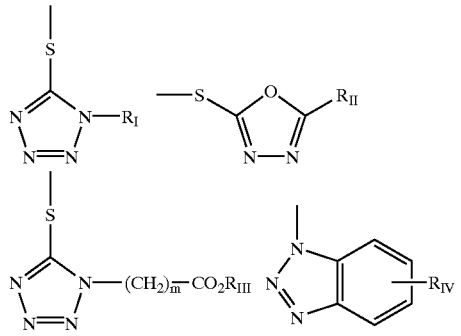

-continued

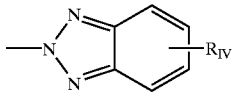

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group, which produces the time-delayed release of the inhibitor group such as groups utilizing the cleavage reaction of a hemiacetal (U.S. Pat. No. 4,146,396, Japanese Applications 60–249148; 60–249149); groups using an intramolecular nucleophilic substitution reaction (U.S. Pat. No. 4,248,962); groups utilizing an electron transfer reaction along a conjugated system (U.S. Pat. Nos. 4,409,323; 4,421,845; Japanese Applications 57-188035; 58-98728; 58-209736; 58-209738) groups utilizing ester hydrolysis (German Patent Application (OLS) No. 2,626,315), groups utilizing the cleavage of imino ketals (U.S. Pat. No. 4,546,073); groups that function as a coupler or reducing agent after the coupler reaction (U.S. Pat. No. 4,438,193; U.S. Pat. No. 4,618,571) and groups that combine the features describe above. It is typical that the timing group or moiety is of one of the formulas:

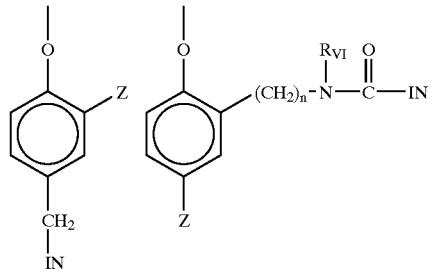

wherein IN is the inhibitor moiety, Z is selected from the group consisting of nitro, cyano, alkylsulfonyl; sulfamoyl (—$SO_2NR_2$); and sulfonamido (—$NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

Suitable developer inhibitor-releasing couplers include, but are not limited to, the following:

D1
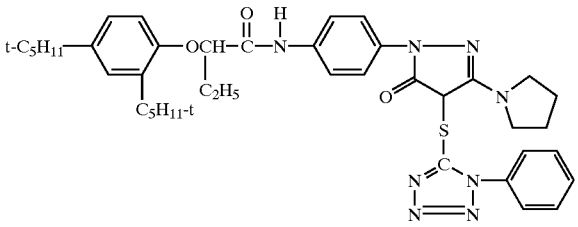
D2
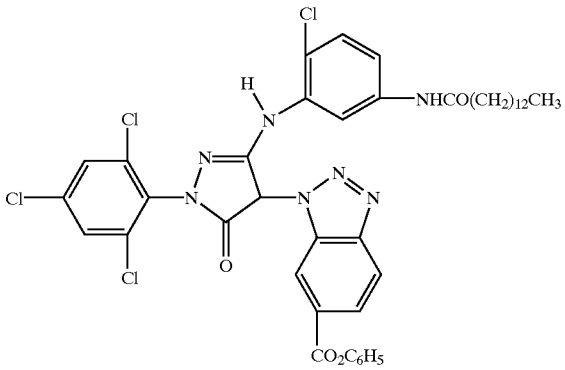
D3
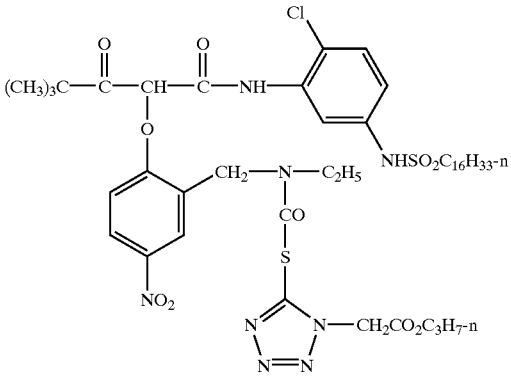
D4
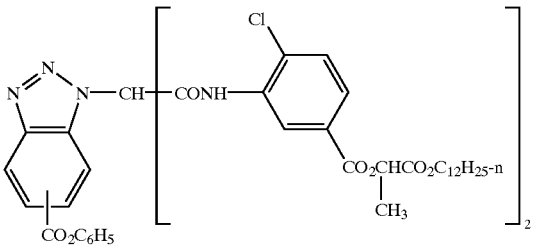
D5
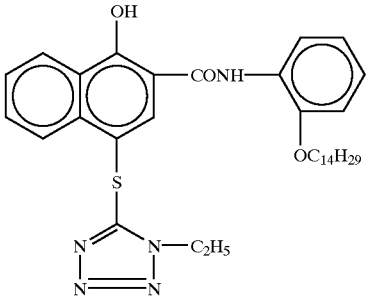
-continued
D6
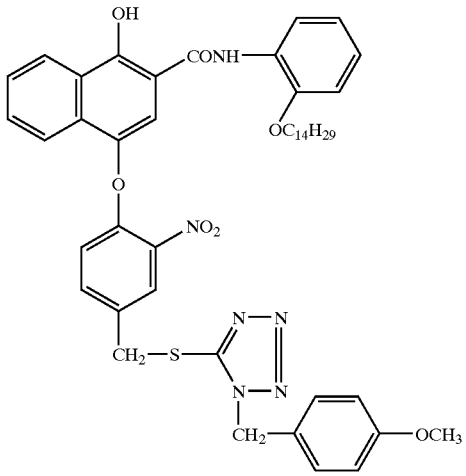
D7
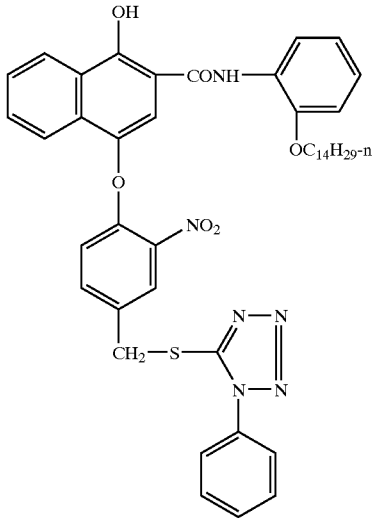
D8
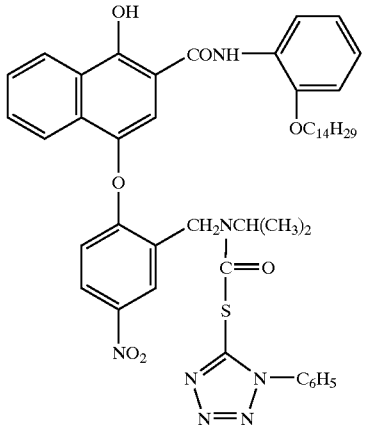

-continued

D9

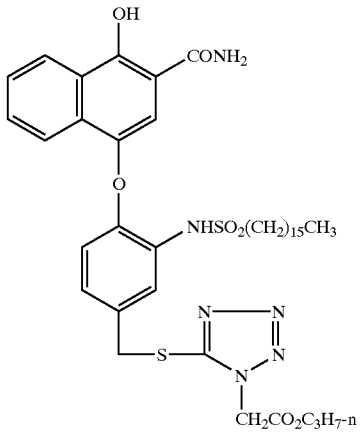

D10

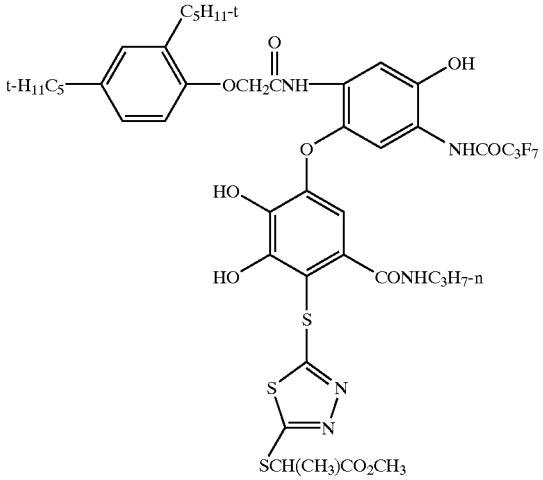

D-11

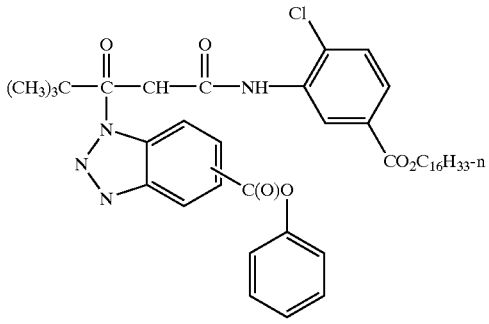

D-12

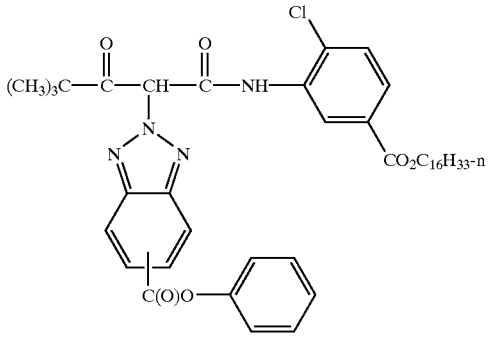

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known Kodak C41 color process as described in the *British Journal of Photography Annual of* 1988, pages 191–198. To provide a positive (or reversal) image, the color development step can be preceded by development with a non-chromogenic developing agent to develop exposed silver halide, but not form dye, and followed by uniformly fogging the element to render unexposed silver halide developable. Such reversal emulsions are typically sold with instructions to process using a color reversal process such as E-6. Alternatively, a direct positive emulsion can be employed to obtain a positive image.

Preferred color developing agents are p-phenylenediamines such as: 4-amino-N,N-diethylaniline hydrochloride, 4-amino-3-methyl-N,N-diethylaniline hydrochloride, 4-amino-3-methyl-N-ethyl-N-(2-methanesulfonamido-ethyl)aniline sesquisulfate hydrate, 4-amino-3-methyl-N-ethyl-N-(2-hydroxyethyl)aniline sulfate, 4-amino-3-(2-methanesulfonamido-ethyl)-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

The invention can be better appreciated by reference to the following specific examples.

EXAMPLE 1

Emulsion E-1 (Comparison)

A reaction vessel equipped with a stirrer was charged with 2.95 g of lime-processed bone gelatin, MAPEG 200 DO™ (dioleate ester of polyethylene glycol, 4-5EO, manufactured by BASF) as antifoamant, 4.04 g NaBr, 1.05 cc of 0.1 M $H_2SO_4$ and sufficient water to form 6 L of solution. Reactor contents were stirred from this point until all $AgNO_3$ used in this precipitation was complete. After warming to 40° C. and allowing the gelatin to dissolve, the reactor and its contents were cooled to 35° C., and 2.5 cc of a 0.06 M KI solution were added. Ten minutes later, nucleation was effected by simultaneous addition of 6.67 cc each of 3 M NaBr and 3 M $AgNO_3$ in 4 sec. Thus, 0.1668% of the total Ag of this precipitation was added during nucleation. Twenty-six seconds after nucleation was complete, 0.728 cc of a 4.80% NaOCl solution was added, and after a 30 sec hold, 90 cc of 5 M NaCl solution were added. After another 90 sec hold, the reactor and contents were heated to 54° C. in 700 sec, after which there was a 120 sec hold at 54° C., then two minutes later addition was made of 100 g of oxidized bone gelatin in sufficient water to form a 1500 cc solution that also contained MAPEG 200 DO™ antifoamant. After an additional 4 min hold at 54° C., 6.93 cc of a 3 M NaBr solution were added in 20 sec. One minute later growth was begun by means of simultaneous accelerated addition of $AgNO_3$, NaBr, and an aqueous suspension of AgI that was peptized by oxidized gelatin. Flows of the respective solutions were maintained so that silver ion potential was held constant at the value set by the cited 6.93 cc addition of 3 M NaBr, and so that the composition of the resulting silver halide was $AgBr_{0.985}I_{0.015}$. After 1.214 moles of Ag(Br,I) was formed in 37.5 min, flow of $AgNO_3$ and AgI was interrupted and 43.76 cc of 3M NaBr was added in 172 sec, then the accelerated triple jet addition was resumed so as to maintain the new silver ion potential. After an additional 1.547 moles of $AgBr_{0.985}I_{0.015}$ was formed in 22.5 min, flow of $AgNO_3$ and AgI was interrupted again and 25.3 cc of 3 M NaBr was added in 39 sec, then the accelerated triple jet addition was resumed again and the resulting silver ion potential was maintained while a total of 6.225 moles of $AgBr_{0.985}I_{0.015}$ was formed in 43.93 min. During this segment, between the time that an additional 5.705 and 5.895 moles of $AgBr_{0.985}I_{0.015}$ had formed, a solution containing $6.0\times10^{-5}$ g of $K_3IrCl_6$ was also added. During a subsequent growth segment, the relative flow of $AgNO_3$ and AgI was adjusted so that the final 3 moles of emulsion, formed in 21.22 min, was of $AgBr_{0.94}I_{0.06}$ composition. Thus, a total of 12 moles of emulsion was formed, the first 75% being 1.5% AgI and the last 25% being 6% AgI. Finally, the emulsion was coagulation washed.

A sample of the emulsion was examined by scanning electron microscopy, and the projected areas of resulting grain images were measured to determine the mean area. The equivalent circular diameter (ECD) of this mean grain area is reported in Table 1. The specific surface area of the emulsion was also determined from the saturation coverage of 1,1'-diethyl-2,2'cyanine dye on a second sample, assuming 0.566 $nm^2$ per dye molecule and the solution extinction coefficient of this dye to be 77,300 L/mole-cm. The equation for specific surface area was solved for thickness, and the result is also reported in Table 1. The aspect ratio in Table 1 is given by the quotient of these measures of ECD and thickness.

Emulsion E-2 (Comparison)

This emulsion tests the level of thiocyanate suggested in U.S. Pat. No. 4,853,323, which discloses use of thiocyanate in silver halide precipitation at a concentration of 0.5 to 60 mole %.

The procedure for precipitation and analysis of E-2 was the same as described above for emulsion E-1, except that in this case NaSCN was included in the NaCl solution that was added after nucleation and prior to growth. The level of thiocyanate added was 480 mg/M Ag, which corresponds to 0.592 mole-%, and which is only slightly above the lower limit suggested in U.S. Pat. No. 4,853,323. Results are given in Table 1.

Note that this level of thiocyanate resulted in an aspect ratio that was lower than in E-1, contrary to object of this invention. Moreover, the emulsion was contaminated with numerous very long rods, which are highly undesirable in manufacture of photographic emulsions, because of complications they cause in emulsion handling and coating, including the plugging of filters, etc. Because prior art levels degrade aspect ratio and morphological purity, this comparative example demonstrates the unobviousness of this invention. These results would lead away from use of thiocyanate in precipitation of tabular grain emulsions.

Emulsion E-3 (Invention)

This invention demonstrates the benefit of using thiocyanate in precipitation of tabular grain emulsions, when used at a level in accordance with the invention.

The procedure for precipitation and analysis of this emulsion was as in Emulsion E-1, except that in this case NaSCN was included in the NaCl solution that was added after nucleation and prior to growth. The level of thiocyanate added was 80 mg/M Ag, which corresponds to 0.099 mole-%, and which is below the lower limit suggested by U.S. Pat. No. 4,853,323. Results are given in Table 1.

Note that addition of NASCN resulted in larger tabular grains than in E-1, with very little thickness increase. Note also that the aspect ratio of E-3 is greater than that of E-1, which demonstrates that use of a low level of NASCN fulfills the object of this invention. Finally, note that this low level of thiocyanate did not degrade morphological purity.

Emulsion E-4 (Comparison)

The procedure for precipitation of this emulsion followed the same general procedure as for Emulsion E-1, but with the following changes: The initial reactor solution contained 1.512× as much KI and had 1.15 as much NaBr. Nucleation temperature was 39° C., and 0.76× as much AgX was formed in nucleation. Thus, 0.1267% of the total Ag added during this precipitation was added during nucleation. NaCl addition was delayed until 60 sec before growth, and only one addition of excess NaBr was made (78 cc of 3M NaBr, after 0.588 moles of Ag(Br,I) had been added in growth). Growth composition was uniform $AgBr_{0.985}I_{0.015}$, growth temperature was decreased to 35° C. in the last 45% of growth, and total growth time was 1.28× that of E-1. The same analysis methods were applied to this emulsion as to E-1. Results are given in Table 1.

Emulsion E-5 (Invention)

This emulsion was precipitated and analyzed by the same procedure as was E-4, but in this case the NaCl solution added after nucleation and before growth also contained sufficient NaSCN to amount to 111 mg of NaSCN/mole Ag, which is equivalent to 0.136 mole % based on Ag precipitated. Results are given in Table 1.

The relative size increase due to the addition of NaSCN in E-5 vs. E-4 is less than seen in E-3 vs. E-1, even though the level of NaSCN is higher in E-5 than in E-3. This is believed to be because in E-5 the NaSCN addition was made at a later time. Note that in E-3, the thiocyanate was added near the start of the ripening step, so that it had opportunity to ripen the nuclei for 90 sec at 35° C., for 700 sec while the temperature was raised from 35 to 54° C., and for 6 min at 54° C. before additional NaBr was added, shortly after which growth was begun. In contrast the thiocyanate in E-5 was present only for 60 sec at 54° C. before NaBr was added. That is, an earlier addition has a greater relative effect on grain size than does a later one. However, NaSCN still has the desired effect of increasing the tabular grain size while only slightly increasing the thickness. Thus the aspect ratio is increased as a result of addition of NaSCN, and the morphological purity was not degraded.

Emulsion E-6 (Invention)

The precipitation of this emulsion followed the same general procedure as for Emulsion E-1, but the following changes: The gelatin in the reactor was of the oxidized lime-processed type, and the iodide was present as AgI rather than KI. Nucleation was carried out at 40° C., during which 0.010 moles of $AgBr_{0.985}I_{0.015}$ was formed. The NaCl solution added prior to growth also contained NaSCN at a level of 120 mg/M Ag (0.149 mole-% based on total amount of Ag precipitated). Growth temperature was 59° C., and 1.88× as much NaBr was added prior to growth, but the other NaBr additions during growth were approximately the same as for E-1. The composition profile for this emulsion was $AgBr_{0.985}I_{0.015}$ for the first 25%, $AgBr_{0.94}I_{0.06}$ for the next 12.5%, then AgBr for the balance of the precipitation. The $K_3IrCl_6$ addition was omitted, and during the last 25% the temperature was decreased to 45° C., and the pBr was raised to approximately 2.9. The same analysis methods were applied to this emulsion as to E-1. Results are given in Table 1.

TABLE 1

| Emulsion | Comparative or Invention | Thickness (μm) | ECD (μm) | Aspect Ratio | Number % Tabular Grains | Number % Rods |
|---|---|---|---|---|---|---|
| E-1 | Comparative (no thiocyanate) | 0.0567 | 1.89 | 33.3 | 97 | 0.5 |
| E-2 | Comparative (Like E1, but 0.592 mole-% NaSCN) | 0.116 | 3.47 | 29.9 | 88 | 10* |
| E-3 | Invention (Like E-1, but 0.099 mole-% NaSCN) | 0.0573 | 2.27 | 39.5 | 97 | 0 |
| E-4 | Comparative (no thiocyanate) | 0.0562 | 2.1 | 37.3 | 98 | 0 |
| E-5 | Invention (Like E-4, but 0.136 mole-% NaSCN) | 0.0576 | 2.27 | 39.5 | 97 | 0 |
| E-6 | Invention (0.148 mole-% NaSCN) | 0.0721 | 3.15 | 43.7 | 95 | 0 |

*Rods in emulsion E-2 ranged in length from 12 to >40 μm.

Spectral Analysis: Transmission

In order to compare the IR absorbance of emulsions prepared in accordance with the present invention to those prepared in accordance with U.S. Pat. Nos. 4,853,323 and 4,921,784, samples of Emulsion E-6 described above and an emulsion prepared in accordance with the description of Emulsion 1 of U.S. Pat. No. 4,921,784 (herein designated comparison Emulsion E-7) were degelled with Takamine, then redispersed in 0.19 M KBr, then centrifuged, redispersed in distilled water, centrifuged again, redispersed in methanol, centrifuged again, and finally dried in a vacuum chamber. A 20 mg sample of the degelled silver halide grains from each emulsion was then placed in a 3 mm Die Set equipped with a rubber o-ring and a 25 mm diameter collar (Wilmad Cat. No. 107-3). The grains were pressed into a transparent window using a KBr Quick Press (International Crystal Laboratories Cat. No. 0012-4977). The press is equipped with a reproducible but arbitrary scale for pressure. The optimum pressure was determined by using the lowest pressure which produced a transparent window, giving rise to the minimum amount of fringing. Representative absorbance results are given in Table 2.

TABLE 2

| Emulsion | Description | Absorbance at 2052 $cm^{-1}$ |
|---|---|---|
| E-7 | Comparison (Repeat of emulsion 1 of U.S. Pat. No. 4,921,784) | 0.075 |
| E-6 | Invention | 0.0005 |

The spectral results of E-7 repeat those of U.S. Pat. No. 4,921,784 well (Table 1 of the cited patent reports an absorbance of 0.07 for Emulsion 1, very close to that shown in Table 2 for E-7 above), and can be taken as a calibration of instrumentation used in this work. While the data for E-6 in Table 2 clearly shows a substantially lower absorbance at 2052 $cm^{-1}$ than that of comparison emulsion E-7, the presence of a small signal does indicate the presence of thiocyanate ions in the silver halide grains. The 2052 $cm^{-1}$ $SCN^-$ absorbance can also be observed with much higher sensitivity using DRIFTS (Diffuse Reflectance Infrared Fourier Transform Spectroscopy) of degelled powders. This technique is capable of distinguishing between $SCN^-$ added during the precipitation of silver halide and that added afterward, for example, as part of the chemical sensitization step: Bands at 2114 and 2070 $cm^{-1}$ are characteristic of $SCN^-$ on the surface of grains, and that material may be removed by a KBr wash. After the KBr wash, however, if thiocyanate was present during precipitation the band at 2052 $cm^{-1}$ remains, and this latter band can be observed with good signal to noise ratio in emulsions made with as little as 10 mg NaSCN/M Ag.

EXAMPLE 2

Speed/Granularity Comparison

Emulsions E-4 and E-5 were each optimally sensitized using a procedure similar to that described for Emulsions L and M of U.S. Pat. No. 5,576,168. Thus these emulsions were dyed to absorb in the red region of the visible spectrum and were chemically sensitized after formation of Ag(Cl,Br, I) epitaxy (nominal composition: $AgBr_{0.42}Br_{0.42}I_{0.16}$). Differences from the cited reference include: 3 mole-% rather than 6 mole-% epitaxy based on the host emulsion, use of Dye 1 and Dye 2 in a 1:1 molar ratio, and use of Sensitizer 1 as the sulfur sensitizer.

Dye 1:

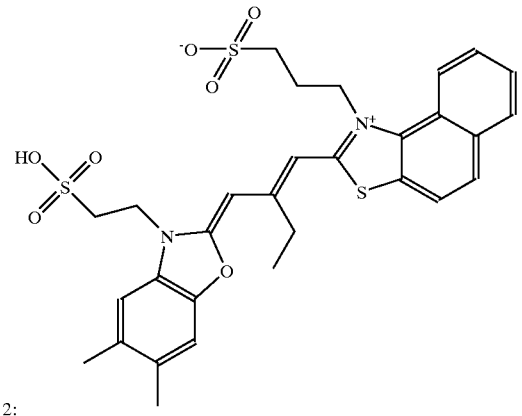

Dye 2:

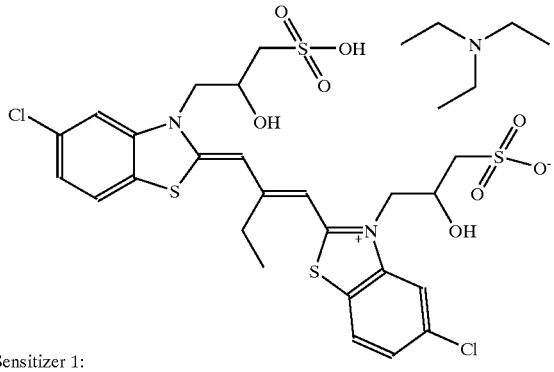

Sensitizer 1:

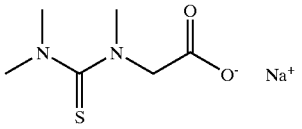

The sensitized emulsions were coated on cellulose acetate support over a gray silver antihalation layer, and the emulsion layer was overcoated with a gelatin layer. Emulsion laydown was 0.646 g Ag/$m^2$ and this layer also contained 0.323 g/$m^2$ and 0.019 g/$m^2$ of Couplers 1 and 2, respectively, 10.5 mg/$m^2$ 4-hydroxy-6-methyl-1,3,3A,7-tetraazaindene ($Na^+$ salt), and a total of 1.08 g gelatin/$m^2$.

Coupler 1:

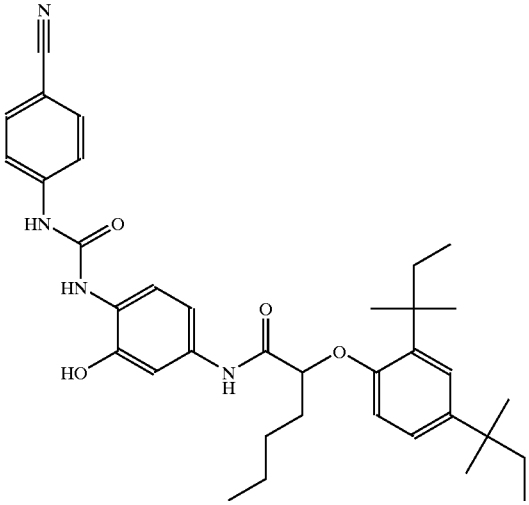

-continued

Coupler 2:

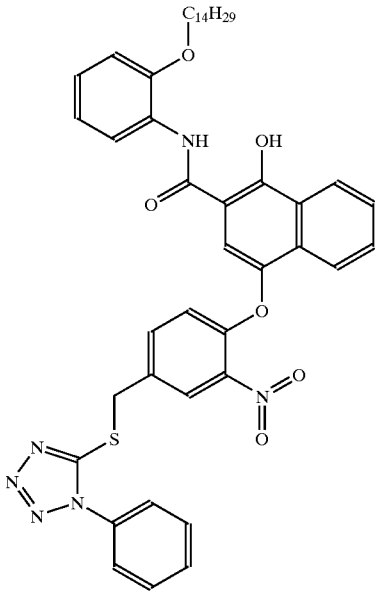

Emulsions so coated were evaluated for speed and granularity, as described in U.S. Pat. No. 5,576,168 column 27, line 65, through column 28, line 25, but with these changes: In the present case, the 21 step granularity step tablet had a density range of 0–4, and speed was measured at a density of 0.15 above Dmin. Results are given in Table 3, where the speed delta is reported in units of 100×ΔLog E, and relative granularity refers to the minimum in the contrast normalized granularity plot. As shown there, the emulsion that was made using thiocyanate as a ripener bad lower Dmin, higher speed, and matched granularity. Therefore use of thiocyanate as a ripener resulted in a speed/granularity advantage.

TABLE 3

Speed and Contrast Normalized Granularity Responses

| Emulsion | Description | Dmin | Relative Speed | Relative granularity |
|---|---|---|---|---|
| E-4 | Comparative (no thiocyanate) | 0.20 | Check | Check |
| E-5 | Invention (Like E-4, but with 0.136 mole-% NaSCN added during precipitation) | 0.18 | +6 | Check |

EXAMPLE 3

Another useful application of the invention was discovered when low levels of thiocyanate were added during precipitation of tabular bromoiodide emulsions of somewhat thicker dimensions. These emulsions were prepared by running a 94/6% bromoiodide salt solution into the kettle during the first 90% of the precipitation to yield grains containing an average of 5.4% iodide. The diameter sizing for this series was performed using a disc centrifugation technique described in U.S. Pat. No. 5,786,898. The Stokes diameter obtained from centrifugation was geometrically corrected to yield the equivalent circular diameter of a tabular grain. Thickness was characterized from the spectral reflectivity of the grains using equations described in *Optics*, p. 582–585, John Wiley & Sons (1970), and the refractive dispersion of gelatin and silver bromide given in *The Theory of the Photographic Process*, 45$^{th}$ Edition, p. 579 (1977).

Emulsion E-8 (Comparison)

A 0.21 M silver nitrate solution was added at the rate of 35 mL/min for 14.83 min into a reaction vessel with good stirring and containing 18.4 g oxidized, lime-processed, bone gelatin, 32.3 g sodium bromide, and an antifoamant in 4.6 L of distilled water maintained at 52° C. Following nucleation, 350 mL of distilled water was added and a digest was performed for 10 min. An additional 222 g of oxidized, lime-processed, bone gelatin together with additional antifoamant in 2.4 L of distilled water was added and growth of the crystals was begun. The first 15 min of growth was conducted at a pAg of 9.310 by the equimolar addition of 3.9 M silver nitrate together with $NaBr_{0.94}KI_{0.06}$ in a double-jet mode. The flow rates were ramped during this time from 7.4 to 22.1 mL/min. During the next 33.24 min the pAg was maintained at 9.177 and the flow rates were ramped from 22.1 to 169 mL/min. At his point 90% of the total silver for the make had been delivered. 160 μg/Ag mol of KSeCN in a total of 276 mL of distilled water was added followed by the addition of a 3.9 M solution of $NaBr_{0.94}$ $KI_{0.06}$ at 187 mL/min for 2 min. 3.9 M silver nitrate was added at the rate of 50 mL/min for 7.90 min at which time the equimolar addition of 3.9 M sodium bromide was begun in a double-jet mode to maintain the pAg at 8.552. The precipitation was then conducted for an additional 8.41 min to yield 15.8 moles of emulsion containing an average of 5.4% iodide. Excess salt was removed by ultrafiltration to give an emulsion with a grain size of 1.52×0.134 μm.

Emulsion E-9 (Invention)

This emulsion was prepared in an identical manner to E-8 except 0.069 mole-% of sodium thiocyanate was added with the addition of 222 g of gelatin to the kettle after the nucleation and digest. The resulting emulsion had a grain size of 1.74×0.118 μm.

As shown in Table 4, the addition of a small amount of sodium thiocyanate to the emulsion precipitation makes the emulsion grains larger and thinner, thereby increasing the aspect ratio.

TABLE 4

| Emulsion | Description | Thickness (μm) | ECD (μm) | Aspect Ratio | Absorbance at 2052 $cm^{-1}$ |
|---|---|---|---|---|---|
| E-8 | Comparative (no NaSCN) | 0.134 | 1.52 | 11.3 | 0 |
| E-9 | Invention (Like E-8 but 0.069 mole-% NaSCN) | 0.118 | 1.74 | 14.7 | 0.005 |

Emulsion E-10 (Comparison)

This emulsion was prepared in an identical manner to E-8 except the make temperature was 40° C., the pAg of the first growth segment was 9.681, the pAg of the remainder of the growth was 9.543 and the pAg of the final precipitation step was 8.890. The resulting emulsion had a grain size of 0.69×0.126 μm.

Emulsion E-11 (Invention)

This emulsion was prepared in an identical manner to E-10 except 0.247 mole-% sodium thiocyanate was added to the precipitation. The resulting emulsion had a grain size of 0.95×0.118 μm.

Emulsion E-12 (Comparison)

This emulsion was prepared in an identical manner to E-10 except 0.493 mole-% sodium thiocyanate was added to the precipitation. The resulting emulsion had a grain size of 0.79×0.154 μm.

Emulsion E-13 (Comparison)

This emulsion was prepared in an identical manner to E-10 except 0.740 mole-% sodium thiocyanate was added to the precipitation. The resulting emulsion had a grain size of 0.71×0.261 μm.

The emulsion series E-10 to E-13 as shown in Table 5 compare the effects of increasing amounts of sodium thiocyanate. When 0.247 mole-% of sodium thiocyanate was added, the grains became larger and thinner with an increased aspect ratio. However, at a level of 0.493 mole-% sodium thiocyanate and above, the grains became thicker leading to a decreased aspect ratio.

TABLE 5

| Emulsion | Description | Thickness (μm) | ECD (μm) | Aspect Ratio |
|---|---|---|---|---|
| E-10 | Comparative (no NaSCN) | 0.126 | 0.69 | 5.4 |
| E-11 | Invention (Like E-10 but 0.247 mole-% NaSCN) | 0.118 | 0.95 | 8.1 |
| E-12 | Comparative (Like E-10 but 0.493 mole-% NaSCN) | 0.154 | 0.79 | 5.1 |
| E-13 | Comparative (Like E-10 but 0.740 mole-% NaSCN) | 0.261 | 0.71 | 2.7 |

Emulsion E-14 (Comparison)

This emulsion was prepared in an identical manner to E-8 except the make temperature was 57° C., the pAg of the first growth segment was 9.165, the pAg of the remainder of the growth was 9.028 and the pAg of the final precipitation step was 8.428. The resulting emulsion had a grain size of 2.23×0.134 μm.

Emulsion E-15 (Invention)

This emulsion E-15 was prepared in an identical manner to E-14 except 0.247 mole-% sodium thiocyanate was added to the precipitation. The resulting emulsion had a grain size of 2.77×0.128 μm.

Emulsion E-16 (Comparison)

This emulsion was prepared in an identical manner to E-14 except 0.740 mole-% sodium thiocyanate was added to the precipitation. The resulting emulsion had a grain size of 2.81×0.173 μm.

The data in Table 6 again demonstrate the ability of thiocyanate to increase the aspect ratio of a tabular emulsion without causing a gain in thickness when added at a sufficiently low level.

TABLE 6

| Emulsion | Description | Thickness (μm) | ECD (μm) | Aspect Ratio | Absorbance at 2052 $cm^{-1}$ |
|---|---|---|---|---|---|
| E-14 | Comparative (no NaSCN) | 0.134 | 2.23 | 16.7 | 0 |
| E-15 | Invention (Like E-14 but 0.247 mole-% NaSCN) | 0.128 | 2.77 | 21.6 | 0.0011 |
| E-16 | Comparative (Like E-15 but 0.740 mole-% NaSCN) | 0.173 | 2.81 | 16.2 | 0.0011 |

The invention has been described in detail with particular reference to preferred embodiments thereof, but it will be understood that variations and modifications can be effected within the spirit and scope of the invention.

What is claimed is:

1. A process of preparing a high bromide tabular grain emulsion comprising a dispersion medium and silver halide grains including tabular grains having {111} major faces and an aspect ratio of at least 2, which contain greater than 50 mole percent bromide, based on silver, and which account for greater than 50 percent of total grain projected area, where such tabular grains have an average aspect ratio of at least 5, the process comprising (i) in a grain nucleation step creating in a dispersing medium tabular silver halide grain nuclei containing parallel twin planes and (ii) in a grain growth step subsequently growing the tabular grain nuclei into tabular grains in a silver halide reaction vessel by adding a silver ion source and a halide ion source to the reaction vessel and precipitating silver halide onto the tabular grain nuclei, wherein thiocyanate ion is introduced into the silver halide reaction vessel prior to the addition of at least the final 10 mole percent of the total silver added to the reaction vessel, and further wherein the introduced thiocyanate ion concentration is at most 0.4 mole %, based on the total silver added to the reaction vessel.

2. A process according to claim 1, wherein the thiocyanate is introduced into the reaction vessel prior to the addition of the final 50 percent of silver added to the reaction vessel.

3. A process according to claim 1, wherein the thiocyanate is introduced into the reaction vessel prior to the addition of the final 90 percent of silver added to the reaction vessel.

4. A process according to claim 3, wherein the thiocyanate ion is added to the reaction vessel after the grain nucleation step (i) wherein less than 5 percent of silver is added to the reaction vessel.

5. A process according to claim 3, wherein the thiocyanate ion is added to the reaction vessel after the grain nucleation step (i) wherein less than 2 percent of silver is added to the reaction vessel.

6. A process according to claim 3, wherein the thiocyanate ion is added to the reaction vessel after the grain nucleation step (i) wherein less than 1 percent of silver is added to the reaction vessel.

7. A process according to claim 1, further comprising ripening out a portion of the silver halide grain nuclei formed in step (i) prior to growth step (ii).

8. A process according to claim 1, wherein the tabular grains have an average aspect ratio of at least 8.

9. A process according to claim 1, wherein the tabular grains comprise at least 0.25 mole % iodide.

10. A process according to claim 1, wherein the tabular grains have an average grain thickness of less than 0.10 $\mu$m.

11. A process according to claim 1, wherein the tabular grains have an average grain thickness of less than 0.08 $\mu$m.

12. A process according to claim 11, wherein the tabular grains account for greater than 70 percent of total grain projected area.

13. A process according to claim 11, wherein the tabular grains account for greater than 90 percent of total grain projected area.

14. A process according to claim 1, wherein the tabular grains account for greater than 70 percent of total grain projected area.

15. A process according to claim 1, wherein the tabular grains account for greater than 90 percent of total grain projected area.

* * * * *